US012729443B2

(12) United States Patent
Marya

(10) Patent No.: US 12,729,443 B2
(45) Date of Patent: Sep. 8, 2026

(54) LEAD-FREE METALLIC BARRIER COATINGS FOR COPPER AND ZINC-RICH SURFACES OF SUBTERRANEAN HARDWARE AND COMPONENTS

(71) Applicant: Schlumberger Technology Corporation, Sugar Land, TX (US)

(72) Inventor: Manuel Marya, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 393 days.

(21) Appl. No.: 18/450,515

(22) Filed: Aug. 16, 2023

(65) Prior Publication Data

US 2025/0059649 A1 Feb. 20, 2025

(51) Int. Cl.

| | |
|---|---|
| ***B32B 15/01*** | (2006.01) |
| ***C22C 18/00*** | (2006.01) |
| ***C23C 2/06*** | (2006.01) |
| ***C23C 28/02*** | (2006.01) |
| ***C25D 3/22*** | (2006.01) |
| ***E21B 17/10*** | (2006.01) |
| ***E21B 43/12*** | (2006.01) |

(52) U.S. Cl.

CPC ..... *C23C 28/021* (2013.01); *C22C 18/00* (2013.01); *C23C 2/06* (2013.01); *C25D 3/22* (2013.01); *E21B 17/1078* (2013.01); *E21B 43/128* (2013.01); *E21B 2200/08* (2020.05)

(58) Field of Classification Search

None

See application file for complete search history.

(56) References Cited

U.S. PATENT DOCUMENTS

2019/0144975 A1* 5/2019 Marya ..... E21B 33/13 420/577

FOREIGN PATENT DOCUMENTS

CN 112410636 A * 2/2021 ..... C22C 30/00

OTHER PUBLICATIONS

ESP power cable, PetroWiki, https://petrowiki.spe.org/ESP_power_cable, accessed from internet on Dec. 11, 2024, 11 pages.

What is Hot-Dip Galvanizing?, American Galvanizers Association, https://galvanizeit.org/hot-dip-galvanized-steel-for-parking-structures/hot-dip-galvanizing, accessed from internet on Dec. 11, 2024, 2 pages.

Reda ESP system cables, https://www.slb.com/completions/artificial-lift/power-systems-and-cables/reda-esp-system-cables, 2 pages.

* cited by examiner

*Primary Examiner* — Daniel J. Schleis

(74) *Attorney, Agent, or Firm* — Kyle R. Miiller

(57) ABSTRACT

Embodiments presented provide for a Lead-free metallic barrier coating. In some aspects, a metallic barrier coating for Copper and/or Zinc-rich surfaces for downhole equipment and components is provided.

19 Claims, 11 Drawing Sheets

Corrosion rates measured in very severe conditions: 180,000 ppm NaCl at pH ~2.75 under 1000 psi H2S, 1000psi CO2, 2000psi CH4 at 450°F with 1g/L S.

| Materials | Bi | Sb | Sn | Zn | Cr+ TME | Total | (Bi+Sb)/ (Sn+Zn) | $T_{liq}$ (°C) | HVN (50g,60 s) | CoF |
|---|---|---|---|---|---|---|---|---|---|---|
| Ingot 1 (A1) | 5.00 | 5.00 | 90.00 | 0.00 | 0.00 | 100.00 | 0.11 | 220 | **24.9** | **0.24** |
| Ingot 2 (A2) | 16.00 | 4.00 | 80.00 | 0.00 | 0.00 | 100.00 | 0.25 | NA | 22 | **0.21** |
| Ingot 3 (A3) | 27.00 | 3.00 | 70.00 | 0.00 | 0.00 | 100.00 | 0.43 | **137-195** | **25** | **0.19** |
| Ingot 4 (A4) | 38.00 | 2.00 | 60.00 | 0.00 | 0.00 | 100.00 | 0.67 | NA | 21.2 | **0.21** |
| Ingot 5 (A5) | 49.00 | 1.00 | 50.00 | 0.00 | 0.00 | 100.00 | 1.00 | **127-156** | **20.6** | **0.20** |
| Ingot 6 (A6) | 65.00 | 0.50 | 34.50 | 0.00 | 0.00 | 100.00 | 1.90 | **136** | **21.8** | **0.23** |
| RepIngot #1 (B1) | 56.00 | 0.00 | 40.00 | 4.00 | 0.00 | 100.00 | 1.27 | **130** | **19.4** | 0.35 |
| RepIngot #2 (B2) | 46.00 | 29.85 | 17.65 | 5.50 | 1.00 | 100.00 | 3.28 | NA | **120** | NA |
| Ref 1 (RO) | 43.00 | 0.00 | 57.00 | 0.00 | 0.00 | 100.00 | 0.75 | **132** | **19.2** | 0.40 |
| Pure Lead (Pb) | 0.00 | 0.00 | 0.00 | 0.00 | 0.00 | 0.00 | NA | 327 | 4.6 | **0.20** |
| Max | 65.00 | 29.85 | 90.00 | 5.50 | 0.00 | 100.00 | 3.28 | | | |
| Min | 5.00 | 0.00 | 17.65 | 0.00 | 0.00 | 100.00 | 0.11 | | | |

Indicates Beneficial

FIG. 10

| Alloy | Bi (wt.%) | Sn (wt.%) | Zn (wt.%) | Cu (wt.%) | Sb (wt.%) | Ni (wt.%) | Cr (wt.%) | Mo (wt.%) | Bi+Sb | Sn+Zn | (Bi+Sb)/(Sn+Zn) | Liquidus (°C) | Solidus (°C) | Hardness (50g) |
|---|---|---|---|---|---|---|---|---|---|---|---|---|---|---|
| C1 | 40 | **40** | 20 | 0 | 0 | 0 | 0 | 0 | 40.0 | 60.0 | **0.67** | 134 | | 38.45 |
| C2 | 60 | 5 | 35 | 0 | 0 | 0 | 0 | 0 | 60.0 | 40.0 | **1.50** | 134 | 407 | 24.6 |
| C3 | **80** | 15 | 5 | 0 | 0 | 0 | 0 | 0 | 80.0 | 20.0 | 4.00 | 134 | | 25.4 |
| C4 | **80** | 0.5 | 19.5 | 0 | 0 | 0 | 0 | 0 | 80.0 | 20.0 | 4.00 | 134 | | 24.4 |
| C5 | **80** | 0 | 16 | 0 | 0 | 0 | 0 | 0 | 80.0 | 16.0 | 5.00 | 253 | | 27.8 |
| C6 | 49.5 | 25.6 | 0 | 0 | 24.9 | 0 | 0 | 0 | 74.4 | 25.6 | **2.91** | 134 | 350 | 66.7 |
| C7 | 59.9 | 20.1 | 0 | 0 | 20 | 0 | 0 | 0 | 79.9 | 20.1 | 3.98 | 134 | > 400 | 51.8 |
| C8 | 70 | 15 | 0 | 0 | 15 | 0 | 0 | 0 | 85.0 | 15.0 | 5.67 | 134 | 280 | 43.5 |
| C9 | 40 | 30 | 0 | 0 | 30 | 0 | 0 | 0 | 70.0 | 30.0 | **2.33** | 134 | 370 | 56.3 |
| C10 | 50 | 0 | 25 | 0 | 25 | 0 | 0 | 0 | 75.0 | 25.0 | **3.00** | 225 | | 164 |
| C11 | 70.1 | 0 | 15 | 0 | 15 | 0 | 0 | 0 | 85.1 | 15.0 | 5.67 | 234 | | 104 |
| C12 | 40 | 21.2 | 8.8 | 0 | 30 | 0 | 0 | 0 | 70.0 | 30.0 | **2.33** | 134 | 450 | 116.4 |
| C13 | 40 | 21.2 | 5.9 | **2.9** | 30 | 0 | 0 | 0 | 70.0 | 27.1 | **2.58** | 134 | 400 | 189.3 |
| C14 | 37.2 | 21.3 | 6.6 | 0 | **35** | 0 | 0 | 0 | 72.2 | 27.9 | **2.59** | 135 | | 97.5 |
| C15 | **36.5** | 20.9 | 6.4 | 0 | 34.3 | **2** | 0 | 0 | 70.8 | 27.3 | **2.59** | 135 | | 116.9 |
| C16 | **36.5** | 20.9 | 6.4 | 0 | 34.3 | 0 | **2** | **2** | 70.8 | 27.3 | **2.59** | 135 | | 165.5 |
| C17 | 46.5 | 17.8 | 5.6 | 0 | 30.1 | 0 | 0 | 0 | 76.6 | 23.4 | 3.27 | 134 | | 154.6 |
| C18 | 46 | 17.6 | 5.5 | 0 | 29.8 | 0 | 1 | 0 | 75.8 | 23.1 | 3.28 | 134 | | 121.5 |
| C19 | 46 | 17.6 | 5.5 | 0 | 29.8 | 1 | 0 | 0 | 75.8 | 23.1 | 3.28 | 134 | | 110.5 |
| C20 | 45.6 | 17.5 | 5.5 | 0 | 29.5 | 1 | 1 | 0 | 75.1 | 23.0 | 3.27 | 134 | | 133.6 |
| MAX | 80.0 | 40.0 | 50.0 | 2.9 | 35.0 | 2.0 | 2.0 | 2.0 | 85.1 | 60.0 | 5.67 | 253 | 450 | 189.3 |
| MIN | 36.5 | 0.0 | 0.0 | 0.0 | 0.0 | 0.0 | 0.0 | 0.0 | 40.0 | 15.0 | 0.67 | 134 | 280 | 24.4 |

Indicates Beneficial

FIG. 11

LEAD-FREE METALLIC BARRIER COATINGS FOR COPPER AND ZINC-RICH SURFACES OF SUBTERRANEAN HARDWARE AND COMPONENTS

CROSS-REFERENCE TO RELATED APPLICATIONS

None.

FIELD OF THE DISCLOSURE

Aspects of the disclosure relate to coatings for subterranean components. More specifically, aspects of the disclosure relate to Lead-free metallic barrier coatings for Copper and Zinc-rich surfaces for downhole components.

BACKGROUND

Powering equipment in a downhole environment is a necessary and complicated endeavor. Many times, powering of such equipment is performed by cables for electric submersible pumps, hereinafter "ESP". A common problem with such ESP cables is that they have Lead (Pb) incorporated into the matrix or materials used. The presence of Lead leads to problems with conduction on other components as well as having deleterious environmental effects. Despite Lead use, failure is common. In some field embodiments, ESP cables are not effectively sealed, permitting corrosion to occur. There is a need to provide a way to seal off steel armor. Because of the high probability of corrosion, there is a need to be able to supplement galvanized (Zinc) coatings. There is also a need to coat end connector pins for improved electrical continuity in the presence of a corrosive environments.

Generally, an ESP cable has a main function to convey electrical power from the surface to the ESP motors and must be designed to survive the aggressive, downhole well environments. The cable architecture must be such that cable diameter remains small enough to fit in the downhole spaces. The cable architecture must also be protected from mechanical abuse and be impervious to physical and electrical deterioration. Cables are available in either round or flat configurations, using several different insulation and metal armor materials depending on the well environments. The ESP cable comprises:

- The conductor: made of Copper wires in a single, solid configuration or in multiple, smaller strands; generally coated with a common Tin or Lead alloy, then insulated with polypropylene. In some environments, direct contact between Copper and polypropylene can cause "Copper poisoning" and in turn, reduce cable life.
- The insulation: commonly made of polypropylene or ethylene propylene diene monomer (EPDM) rubber, depending on operational temperature limits.
- Protective layers: applied over the insulation; including tapes and braids of extruded continuous polymer barriers, made of nylon or polyester, or a Lead barrier. Lead barriers provide the best protection against fluids and gases because it is a metal that is impervious to well fluids, and thus can prevent Copper corrosion, especially in highly sour wells. The major disadvantage of Lead is its weight and specialized handling because of limited bendability, e.g., cables cannot be sharply bent. Other disadvantages of Lead are its low sustainability, hazardous nature, and low recyclability. There is a need in the industry to substitute Lead with a more environmentally friendly material.
- The jacket: designed to protect the insulation from physical damage. In round cables, the jacket fills the space between the insulated conductors and the inside of the armor, effectively protecting the whole cable from oil and decompression swelling. Typical jacket materials include nitrile and EPDM rubber.
- The metal armor: wound around the three, insulated conductors (flat cable) or the jacketed conductors (round cable), having a primary function of protecting the insulated conductors. On a round cable, it has the added function of providing further containment for oil swelling and gas decompression. The armor is usually made of mild galvanized steel for non- to mildly-corrosive wells. In more-corrosive applications, stainless steel and highly, corrosion resistant, alloys are used.

In contrast to ESP cables, wireline cables do not comprise a metal barrier such as Lead (Pb). There are basic types of wireline cables; multi-conductor, single conductor, slickline, and braided line, in addition to wirelines with sheathed slickline and fiber-optic lines. Multi-conductor lines consist of external, armor wires wound around a core of typically four or seven conductors. The conductors are bound together in a central core, protected by the external, armor wires. Conductors are used to transmit power to the downhole instrumentation and transmit data (and commands) to and from the surface.

Single-conductor cables are similar in construction to multi-conductor cables but have only one conductor. These cables are employed in pressurized wells due to their size, making them particularly suited for cased-hole, logging activities. They are typically used for well construction activities such as; pipe recovery, perforating, and plug setting, production logging and reservoir production characterization activities (production logging, noise logging, pulsed neutron, production fluid sampling and production flow monitoring).

Slickline is a smooth, single strand of wireline. Slickline has no conductor (although there are specialized, polymer, coated slicklines and tubing encapsulated (TEC) slicklines). Slickline is used for light well construction and well maintenance activities, as well as subsurface data gathering. Slickline work includes mechanical services such as gauge emplacement and recovery, subsurface valve manipulation, well bore cleaning and fishing. For all these wireline applications, there are great concerns over the armor degradation by corrosion, and a protective coating potentially exceeding the performance of the current galvanized coating on steel would be an improvement to extend cable life and provide an additional guarantee against potential loss of assets.

Over the years, there have been numerous initiatives to increase the life of Copper bearing components, particularly among structural parts. Copper is a widely utilized metal in downhole tools for a variety of purposes and applications; electrical, thermal and structural. Copper (annealed and commercially pure) is irreplaceable in electrical wires, cables, motor windings, connectors, among others. Copper, when alloyed with Tin (to produce brass), or nickel (bronze, aluminum bronze, etc), is used as a bearing and bushing alloy, but also for structural applications such as couplers (threaded rings), connectors, and even pressure housings. One such alloy (of premium type) is UNS C72900 (e.g., CuNiSn or Toughmet by Materion™), available between 95 ksi and 150 ksi and widely used in drilling and measurement applications, and occasionally in pumping applications, for its high machineability and dry lubricity. Copper is also found at 33 wt. percent in Monel (Ni—Cu alloys) for other structural applications; including bolts, fasteners, gas-lift housings, bearings and threaded parts. Beryllium Copper is also found in electronic chassis because of its combination of high strength and thermal diffusivity, two properties required in high-temperature tools, as found for HPHT or geothermal applications.

In reservoir characterization (when in contact with oilfield fluids), Copper alloys rarely last very long as they suffer from heavy corrosion, particularly in the presence of sour gas, at temperatures in excess of approximately 125 degrees C. (approximately 250 degrees F.).

A short list of Copper alloys (with internal designation, UNS Cxxxxx) is provided next along with current applications where a coating may be beneficial:

- Oxygen-free Copper (C10100): high electrical and thermal conductivity, high impact strength.
- Tellurium Copper (C14500): superior machineability combined with its high electrical and thermal conductivity.
- Chromium Copper (C18200): heat treatable, corrosion resistant, alloy with high electrical conductivity and high strength. Used in cable connectors and electrical switch gears.
- Beryllium Copper (C17200, C17300): combined, high-temperature, strength and used in many structural applications including chassis, pressure housing, coupling connectors. Also, perfectly, magnetically, transparent for downhole applications.
- Free-machining brass (C36000): high-speed, volume, machining operations, used in shear components.
- Naval brass (C46400): corrosion resistance in seawater.
- Phosphorus bronze (C51000): bearings, bushings, gears, pinions, shafts, thrust washers and valve parts.
- Aluminum bronze (C61400): high tensile strength and a good yield, along with an inherent toughness and ductility. Used whenever good resistance to corrosion, erosion, and abrasion is crucial.
- Nickel Aluminum bronze (C63000): applications involving heavy loads, adhesive wear, friction, abrasive wear, and corrosion. Used in bearings, main pistons, trunnion bearings and similar vital components.
- Silicon Aluminum bronze (C67300): high strength, leaded, Silicon, Manganese bronze with good bearing qualities. Used for bushings, sleeve bearings, thrust bearings and pump parts.
- Copper Nickel (C70600): corrosion resistance to brine water, organic compounds, salts and diluted non-oxidizing acids. This alloy is especially resistant to marine, saltwater environments. C70600 Copper Nickel also contains Iron and Manganese which is necessary to maintain good corrosion resistance.
- Copper Nickel Tin (C72900, C96770; known as Toughmet from Materion™): high strength, low friction, and structural applications, among which are threaded couplers and pressurized parts.

Many oilfield applications involving Copper have a need for an economical and easy to apply protective coating that is corrosion resistant, either at the surface of tools (hardware), or as part of an electrical conductor, to provide long-term protection against corrosive gases such as hydrogen sulfide ($H_2S$). One example is cast, Zinc alloy, centralizers for the deployment of downhole sand screens (SMS). The centralizers only have the temporary function of positioning at the center of the bore hole tubulars (namely sand screens in SMS) during their deployment downhole up to gravel packing. Once gravel packing is completed, the screen is set in its permanent place and the centralizers become non-critical and are permitted to corrode. In some fields, wherein the conditions are corrosive, the deployment is slow, or the gravel packing delayed, and barrier coatings may be advantageously applied to centralizers to increase survivability in the downhole environments. In addition to corrosion resistance, the coatings have low friction coefficients (CoF), an advantage when conveying the centralizers to their final position downhole (low friction implies an easy slide or trip downhole with low risk of abrading to costly and critical downhole tubulars and equipment).

There is a need to provide an apparatus that is easy to operate in downhole environments, while having superior environmental properties compared to conventional apparatus.

There is a further need to provide apparatus that do not have the drawbacks discussed above, namely corrosion in high $H_2S$ environments.

There is a still further need to reduce economic costs associated with operations and apparatus described above with conventional tools by providing tools that are fit for anticipated aggressive environments.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a component is disclosed. The component may comprise at least two consecutive layers wherein a first layer is reactive to at least one of Copper and Zinc, produces an intermetallic when in contact with at least one of solid Copper and Zinc, and a second layer in contact with the first layer wherein the second layer has a compositional range of approximately: (Bi+Sb)/(Sn+Zn) in between 0.5 and 3.0 wt. percent, Bi: approximately 27 to approximately 70 wt. percent, Sn: approximately 5 to approximately 40 wt. percent, Sb, Zn, and other elements as balance and is characterized by a hardness of 18 HVN, or at least 4 times higher than the hardness of Lead in the HVN scale, wherein Bi represents Bismuth, Sb represents Antimony, Sn represents Tin, and Zn represents Zinc.

In another example embodiment, a method for production of a component is disclosed. The method may comprise obtaining a body of material, wherein the body of material has one of a Copper and Zinc-rich surface. The method may also comprise cleaning the body of material. The method may also comprise covering at least a portion of a surface of the body of material with a first layer. The method may also comprise covering at least a portion of the first layer with a second layer wherein the second layer has a composition of: (Bi+Sb)/(Sn+Zn) in between 0.5 and 3.0 wt. percent, Bi: 27 to 70 wt. percent, Sn: 5 to 40 wt. percent, Sb, Zn, and other elements as balance, and is characterized by a hardness of 18 HVN, or at least 4 times higher than the hardness of Lead in the HVN scale, wherein Bi represents Bismuth, Sb represents Antimony, Sn represents Tin, and Zn represents Zinc.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

FIG. 10 is a table of useful combinations of elements for embodiments of the disclosure.

FIG. 11 is a second table of useful combinations of elements for embodiments of the disclosure.

Figure 1:
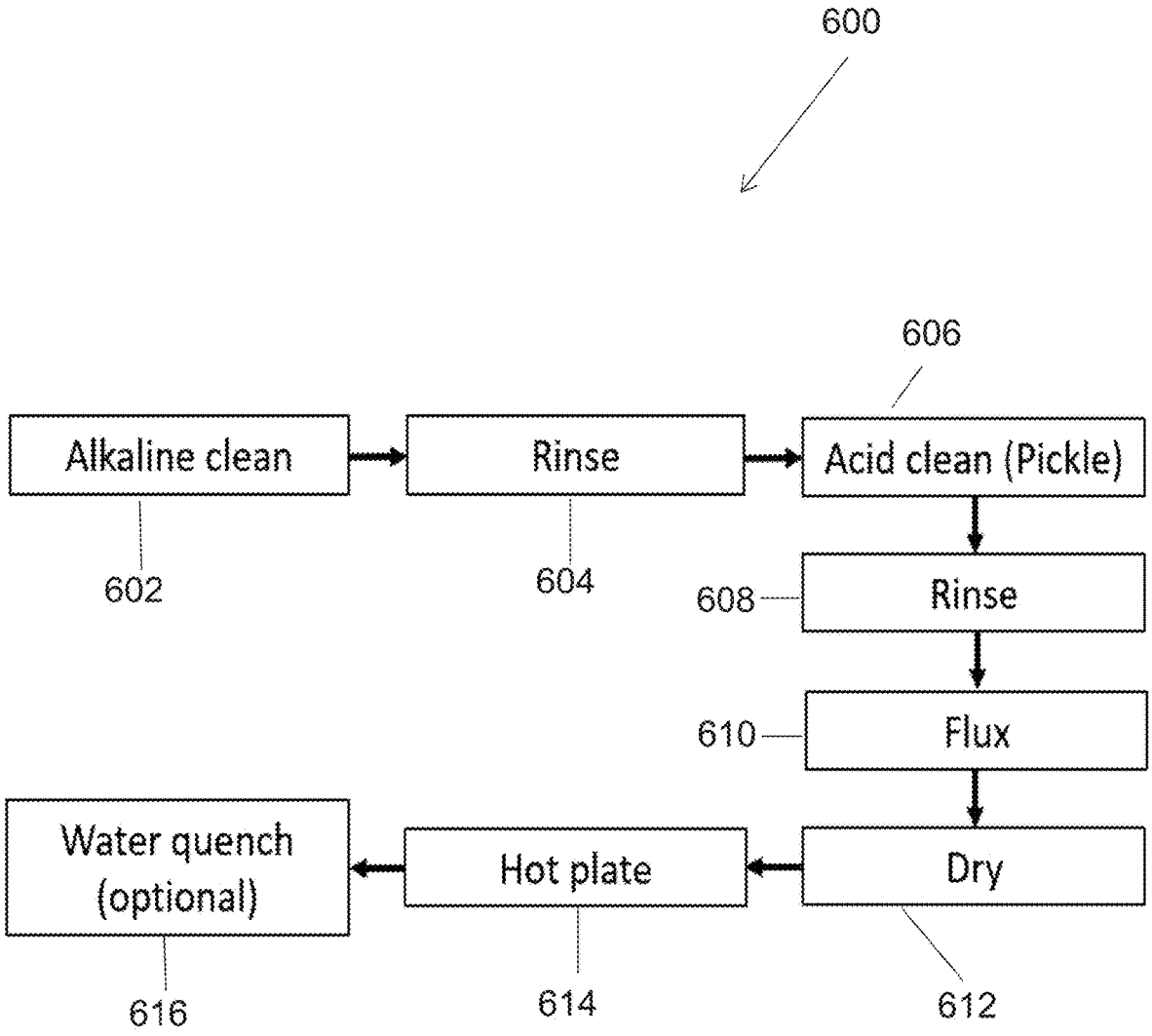
FIG. 1 is an example embodiment of a cleaning process to ensure good wetting and bonding of an alloy.

To facilitate understanding, identical reference numerals have been used, where possible, to designate identical elements that are common to the figures ("FIGS."). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure provide for a family of barrier coatings and method to produce the family of barrier coatings to be used in downhole conditions. By definition, such downhole conditions are the environmental conditions that are present during oil and gas recovery operations. In instances, the barrier coatings may be used in the following applications.

Barriers and shields for electrical cables.

Barriers for electrical motor wires. A conductor wire with a coating may offer a solution for motors running in aggressive, corrosive environments, particularly when water and aggressive gases are in risk to be in direct contact with such motor windings/wires.

Barriers for electrical connectors (bulkheads). Similarly to the above, connectors are exposed to aggressive environments, meaning it is not uncommon to observe electrical connect pins subject to corrosion and electrical failures. A highly protective and electrically-conductive coating, with low temperature applicability, is a solution towards increasing connector reliability.

Protective coatings for alloys. In downhole tools, particularly for drilling and logging, there are numerous applications for Copper alloys in critical structural applications. In wireline equipment, high-strength Copper couplings are very common, and are essential to wireline equipment including a variety of measurements and logging capabilities.

Conventionally, there are several metallic coatings available to protect Copper. These include Zinc (95 percent min), Silver, Gold, Tin (pure), and Nickel (Ni>90 percent), among others, all offering a range of disadvantages. Nickel (particularly Ni—P electroless nickel plating) is attractive for mechanical parts, but is very hard and lacks any flexibility. The deposition processes are lengthy and not compatible to cable manufacturing processes. The most common application processes are by plating (including electroplating). By comparison, hot dipping and extrusion are less utilized and, in fact, are quite rare and special to ESP cable manufacturing. Hot dipping is common to Zinc plating (galvanizing) and occurs quickly, at a temperature not causing detrimental effects to its substrate. Typical galvanizing times take seconds at a temperature of 830 degrees F.

Aspects of the disclosure provide for a broad range of applications. In aspects of the disclosure, aspects for a differentiating coating solution are as follows:

- Applicable to pure Copper, Zinc, and their alloys, thus with chemical affinity for Copper and Zinc (for instance, when applied to galvanized steel).
- Sufficient fatigue resistance in order to be bent and unbent many times.
- Flexible, in order to swage down a cable substrate, and provide pressure compensation.
- Economical and widely available to address major applications.
- Processable at low temperatures, at least lower than Lead, to allow a range of controllable extrusion thickness when used as a barrier.
- Potentially self-healing, meaning when used close to or above a temperature where the alloy presents an exceptionally soft phase, including a liquid phase, creep and incipient melting at operating temperature and pressure conditions can cause cracks and defects formed during service to rapidly disappear. This condition would apply when a barrier of the inventive alloy is used in between other layers (like in cables), so that to be free of a large amount of fluid, the environmental conditions (pressure, temperature) would close a crack.

As a replacement to Lead (Pb), aspects of the embodiments use Bismuth, among other metals or alloying elements. Bismuth is rarely used elsewhere in engineering materials because it is difficult to process; however, it offers excellent anti-seizing and anti-corrosion resistance, among other properties. Tin is a low-melting point metal that is an excellent start to build a low-temperature process capable of being applied to ESP cables, and a variety of alloys, without thermally impacting pre-coating mechanical properties. Tin (Sn) may be used as a thin coating; therefore, certain alloys of tin may also be beneficially used. Aspects of the disclosure specifically target barrier coatings or layers containing Bismuth, which is the critical element providing corrosion resistance, and also an element rarely used in engineering applications.

Hot-dipped plating tests were conducted on a number of Copper and Copper alloy substrates to determine basic properties of the coating as well as acquire some sense of the coating processability. Environmental exposures tests were also conducted in pressurized autoclaves containing corrosive brines and gases, particularly $CO_2$ and $H_2S$ as a means to compare some of the alloys presented herein against Lead, used as reference and common in ESP cable shields. Test coupons, in the form of washers and coupons, extracted from solid bar stocks, were prepared and tested for their ability to receive any new alloy formulation as coating. These test coupons were prepared in a normal surface-finish condition. Prior to hot dipping in molten baths of the inventive alloys, the test coupons went through a series of cleaning steps to ensure good and continuous reaction with the molten liquid bath. These two steps consisted of degreasing and pickling; for larger scale application, fluxing is also recommended as conducted for hot-dip galvanizing. Referring to FIG. 1, a method 600 of cleaning to ensure good wetting and bonding of the alloy is illustrated. Alkaline cleaning occurs at 602, followed by rinsing at 604, and acid cleaning, referred to as pickling, at 606. Although the pickling bath is normally to remove scale, followed by fluxing, these steps are not always necessary. After pickling at 606, the test coupons were rinsed at 608, in neutral water, fluxed at 610, and rapidly air dried at 612. Hot plating at 614, is conducted with an optional water quench at 616. FIG. 1 explains the typical process that needs to be applied to ensure good hot dipping, a pre-requirement to the strong wetting and bonding of any new coating applied by a hot dipping process. The process described in FIG. 1 applies not only to hot dipping, but also electroplating, electroless plating, or plasma spray, a process where the inventive alloy would be violently sprayed as powder onto a substrate.

Figure 2:
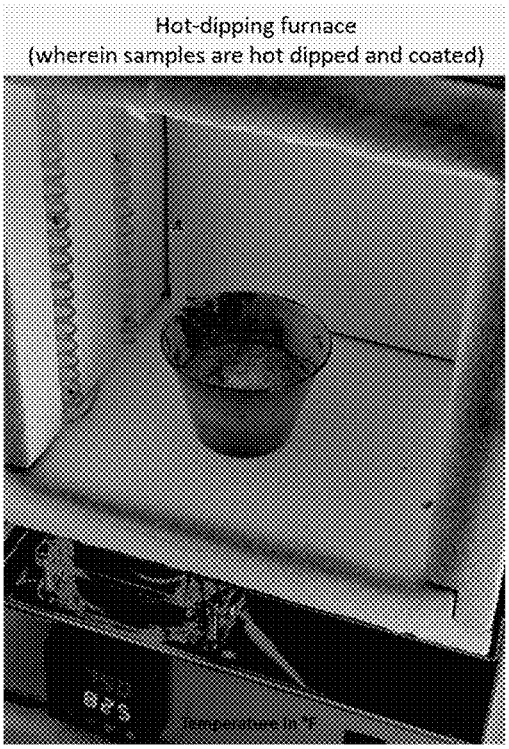
FIG. 2 is a production of an alloy using a melting route.
Figure 2:
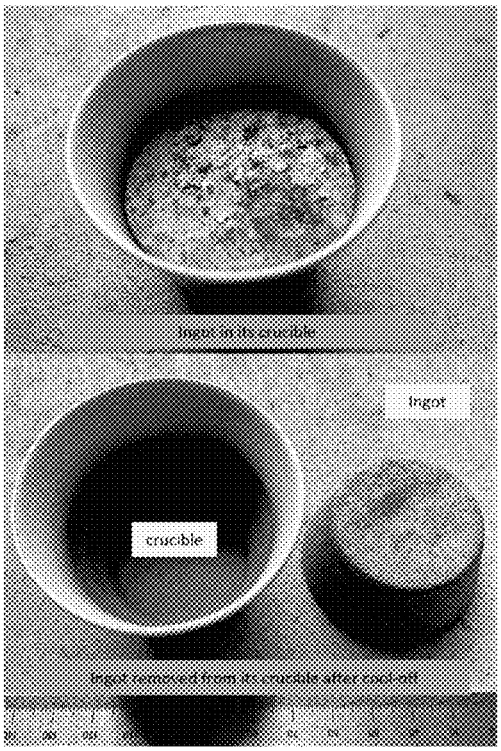

Hot dipping was conducted by re-melting various ingots, specially formulated with specific chemical compositions, and anticipated properties. The ingots were first produced out of high-purity pure metals (99.9 wt. percent min), poured into refractory-coated stainless-steel crucibles, then remelted at low-temperature in a small box furnace, as depicted in FIG. 2, for a variety of small test coupons to be hot-dipped. Hot dipping time occurs typically within seconds to tens of seconds, with limited control over the plating conditions, presently. Among technical challenges were the oxidized scales, creating a barrier to proper plating, a challenge usually not present in proper hot dipping conditions, potentially by use of fluxes. Hot dipping was conducted at 850 degrees F.

The hot dipping was achieved at a temperature comparable to galvanizing, even though the current alloys are liquefied at a temperature considerably lower than a galvanizing Zinc bath. As substrates, the following materials were evaluated for their ability to be directly hot plated by immersion into liquid melts:

- Commercial Copper (as washers)
- Galvanized steel (as washers)
- Brass (as washers)
- Nickel-plated brass (as washers)
- Toughmet 3AT (as rectangular machined test coupons)
- Monel 400 (as rectangular machined test coupons)

Figure 3:
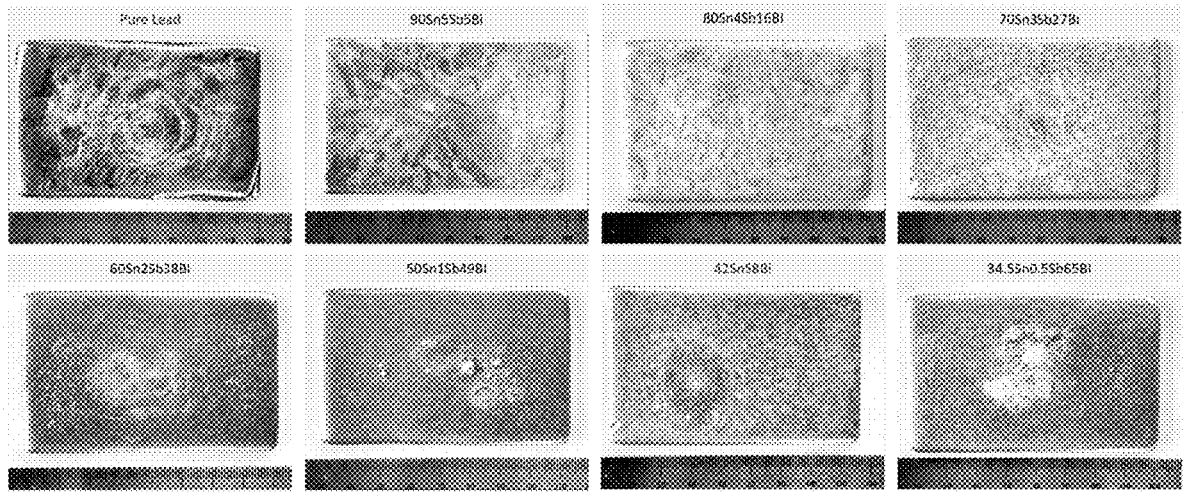
FIG. 3 is a sample gallery of ingots to provide for test coupons.

Upon completing hot dipping trials, on duplicate test coupons, the hot dipping baths were poured into rectangular plates as shown in FIG. 3. These were utilized for complementary tests, particularly mechanical, tribological, and corrosion tests.

FIG. 10 shows a list of ingots produced for plating tests, while FIGS. 2 and 3 show examples of hot-dipped test samples. Also shown in FIG. 10, are alloy design criteria using various compositions and compositional ratios, as well as a number of measurements to determine onset of melting temperature (liquidus), hardness and coefficient of friction (CoF) under dry and unlubricated conditions. Melting temperature was determined in accordance with the American Society for Testing and Materials ASTM D3418, using a differential scanning calorimeter (DSC). Hardness was measured through repeated microhardness indentations under 50 g load as per ASTM E384, with all samples ground and polished prior to measurements. Measurements were repeated at least three times to provide average values. Coefficient of friction (CoF) was determined under dry conditions against a steel ball using a modified procedure using a wear tester and mimicking as best as feasible ASTM D1894. CoF measurements were conducted under a light load at a velocity of 0.42 mm/sec.

FIG. 10 shows a range of useful compositions incorporating Bismuth (Bi), Antimony (Sb), Tin (Sn), Zinc (Zn) and, in an instance, Chromium (Cr), and other transition-metal elements. Also listed in the last row is Lead (Pb) that serves as a reference for comparison purpose. Melting temperature, alloy hardness (as solidified), and coefficient of friction (CoF) are all listed, as measured, per the short procedure earlier described. The following has been established:

The disclosed alloys are much easier to melt than Lead; i.e., less thermal energy is required for melting and processing these alloys onto a substrate.

The disclosed alloys are consistently harder, thus improving wear resistance, including against scratches.

The disclosed alloys have comparable friction coefficients as Lead (Pb), and such coefficients of frictions is about 50 percent lower than steel, stainless steel or nickel alloys.

The rationale for combining Bismuth (Bi) and Antimony (Sb) and combining Tin (Sn) and Zinc (Zn) in additive ways are as follows:

Bi and Sb are mutually soluble: Both Bi and Sb do not stabilize any liquid phase at a lower temperature (eutectic liquid). Also, both are metals that are unusual because they expand upon freezing. In order to produce a reliable barrier with neither expansion nor contraction in the presence of melting (even incipient) the (Bi+Sb) percentage is controlled and offset by the other alloying elements, namely Tin (Sn) and Zinc (Zn), among others. For an alloy composition with nearly no volumetric change at melting (or solidification), the ratio (Bi+Sb)/(Sn+Zn) may be between approximately 0.5 and 3.0. Such conditions are important for barriers entrapped in between other layers, as the case of Lead in cables. For coatings on downhole tool parts or accessories, it may be beneficial to have an expansion upon incipient melting, and as such the ratio (Bi+Sb)/(Sn+Zn) should be on the upper side of the recommended range.

Sn and Zn both form eutectic systems and have limited mutual solubility with Bi, especially at low temperatures. Across most of the compositional range, both Sn and Zn stabilize a liquid at lower temperatures than the melting temperatures of Bi and Sb. Further, both Sn and Zn, form with Bi and Sb hardening phases that can contribute towards improved creep resistance, as may be needed by some of the claimed oilfield applications.

Figure 4:
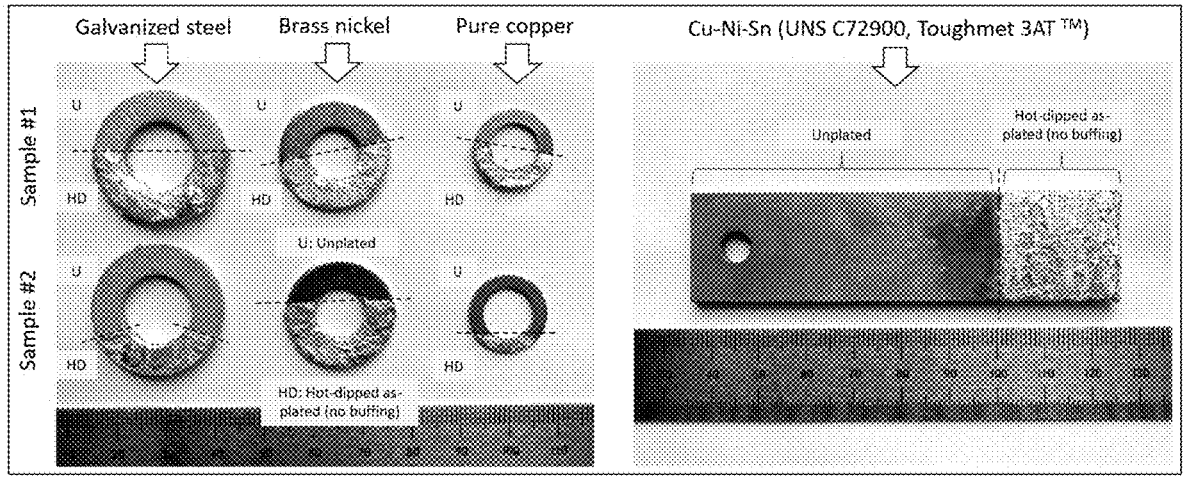
FIG. 4 is a depiction of examples of plated test coupons with Alloy A2.
Figure 5:
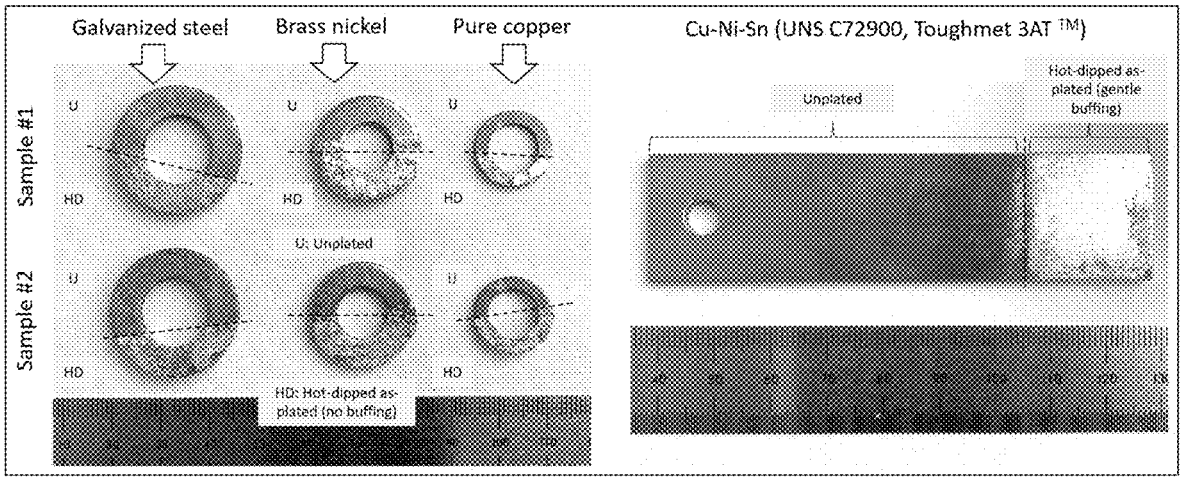
FIG. 5 is a depiction of examples of plated test coupons with Alloy B1.

FIGS. 4 and 5 show test samples made of various substrates (alloys) that have been coated by an experimental "hot dipping" process. Even though the coating appears irregular, the majority of the substrates were successfully plated upon short immersion into remelted alloy crucibles (as shown in FIG. 2). In the figures, note that U refers to "uncoated" and HD to "hot dipped". Each test was completed on at least two samples per substrate. The adhesion to nickel was poor, making the proposed alloy not a reliable solution for such an alloy family.

Figure 6:
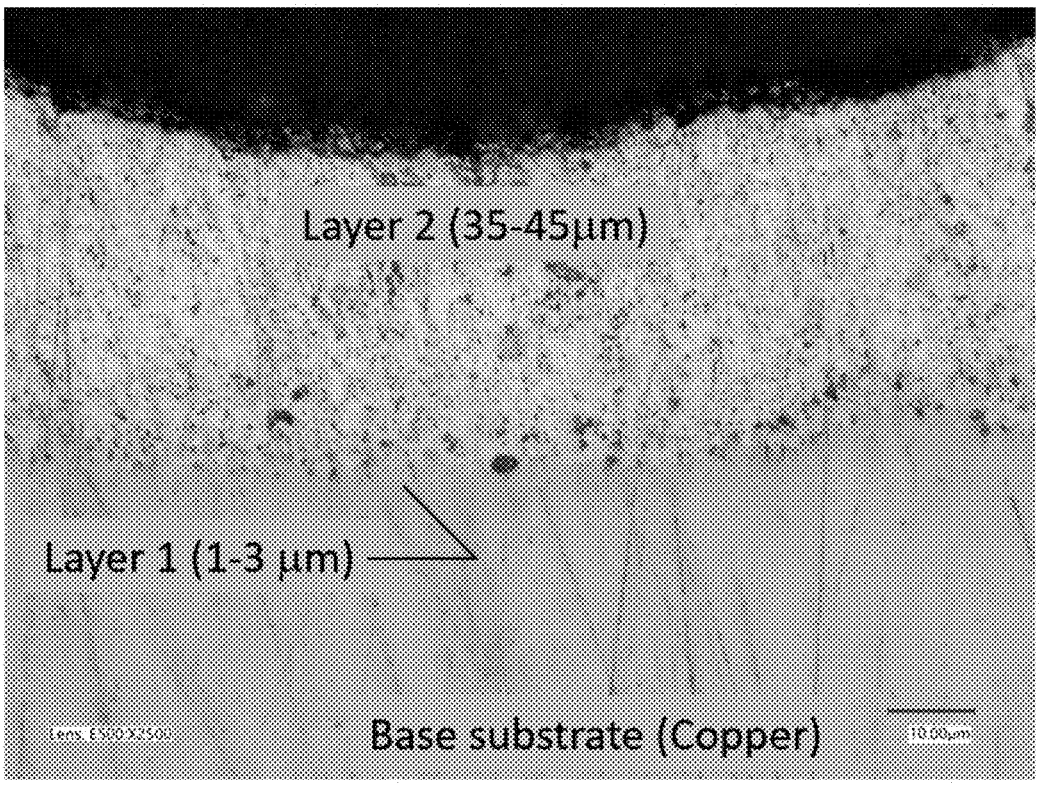
FIG. 6 is an example optical microstructure of a typical coating in conformance with one example embodiment of the disclosure.

FIG. 6 shows the metallurgical cross-sections of a plated sample, specifically a plated Copper alloy of Cu—Ni—Sn (as shown in FIG. 4). Two-layers are seen on the coating: A relatively, thin, first layer produced by interdiffusion between the alloy and the substrate, and a second layer largely comprised on the new alloy. The first layer, despite its thickness, can be produced very uniformly over the whole immersed sample surface provided proper process control and precautions are taken to promote wetting (e.g., use of flux). The second layer is more defective, but thicker, making it quite impervious to well fluids.

TABLE 1

| | 5% CH3COOH at 21° C./70° F. (PH~2.4) |
|---|---|
| A1 | No Corrosion |
| A2 | No Corrosion |
| A3 | No Corrosion |
| A4 | No Corrosion |
| A5 | No Corrosion |
| A5 | No Corrosion |
| B1 | No Corrosion |
| B2 | No Corrosion |
| R0 | No Corrosion |
| Lead | No Corrosion |

Figure 7:
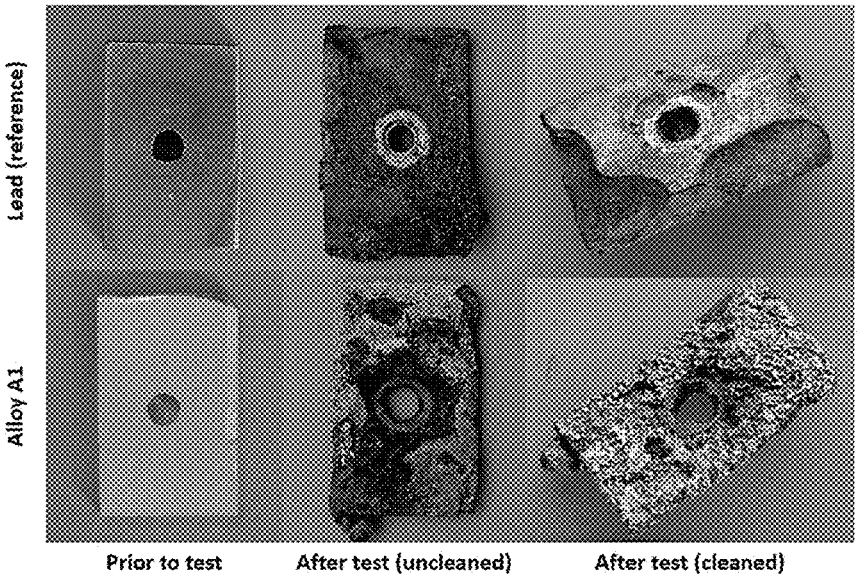
FIG. 7 is a depiction of corrosion tests in autoclave conditions.
Figure 7:
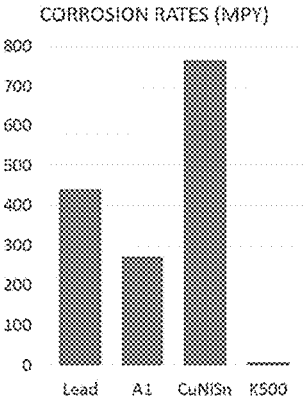

Table 1 presents test results, wherein the alloys of FIG. 10, have been tested in acetic acid for uniform corrosion (pH approximately 2.4, 48 hours test, 70 degrees F./21 degrees C.; solution selected for rapid screening purpose). In none of the cases was corrosion observed, an indication that all these alloys are promising in terms of corrosion resistance, and in fact, no worse than the Lead currently in use in cables. FIG. 7 discloses the results from a totally independent and complementary test wherein both Lead (Pb) and Alloy A1 from Table 1 were exposed to a highly corrosive environment. Alloy A1, likely the least corrosion resistant of all A-alloys of Table 1 (due to its lower Bismuth content) outperforms Lead. This result demonstrates that the high corrosion resistance of proposed alloys makes them promising for permanent barriers and coatings.

While the previous alloys were designed for improved processing and manufacturability at low temperatures (<Pb), additional alloys may be used. Compared to the alloys of FIG. 10, the alloys of FIG. 11 are designed with very different requirements, yet they consistently show a low melting temperature. The ratios of (Bi+Sb)/(Sn+Zn) are provided to gauge volumetric change during solidification and conversely, melting shrinkage. Of particular interest are alloys having the following characteristics:

A melting range between 134 degrees C. and >225 degrees C., or >175 degrees C. and >225 degrees C.

For most applications, >175 degrees C. is a more accurate requirement.

A hardness in excess of 25 HVN.

Recall that Pb is at 4, and the alloys of FIG. 10 are approximately 25 HVN.

FIG. 11 shows (Bi+Sb) alloys with a peculiar low temperature melting and also an elevated hardness, as was intended for a metallurgical zone isolation plug. For the embodiments disclosed, the interest is primarily among other alloys within the disclosed compositions where the melting temperature is expected to be increased and where the hardness is above 25 HVN. Also, to ensure the alloy neither expands nor shrinks too much during melting or solidification, the preference is for alloys meeting the following criterion:

$$0.5<(Bi+Sb)/(Sn+Zn)<3.0$$

A number of alloys meet the above criterion and many other alloys are expected within the compositional range and criteria of FIGS. 10 and 11.

Figure 8:
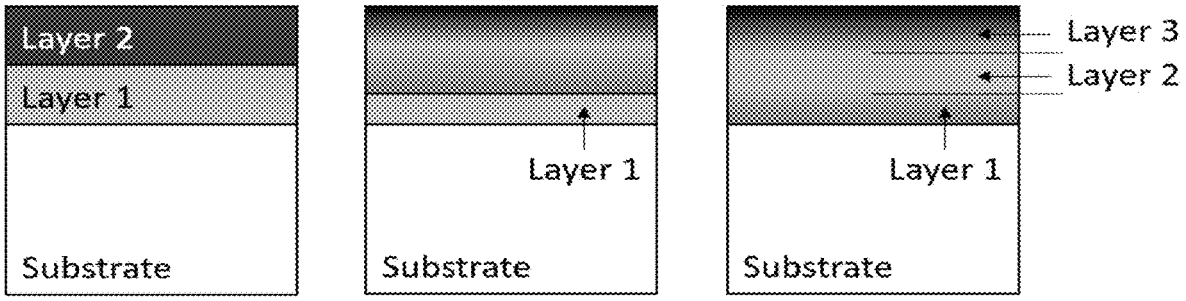
FIG. 8 is a cross-section of typical architectures for coatings in example embodiments of the disclosure.

Referring to FIG. 8, typical cross-sections of coating applications are shown. In the first embodiment, a double layer of materials are put over a substrate. In this embodiment, both of the layers are of equal thickness. In the second embodiment, a single covering layer of material is placed over the substrate. A top layer is also placed over a single covering layer. In the third embodiment, three individual layers are intermixed over the substrate. As will be understood, other configurations are possible.

Figure 9:
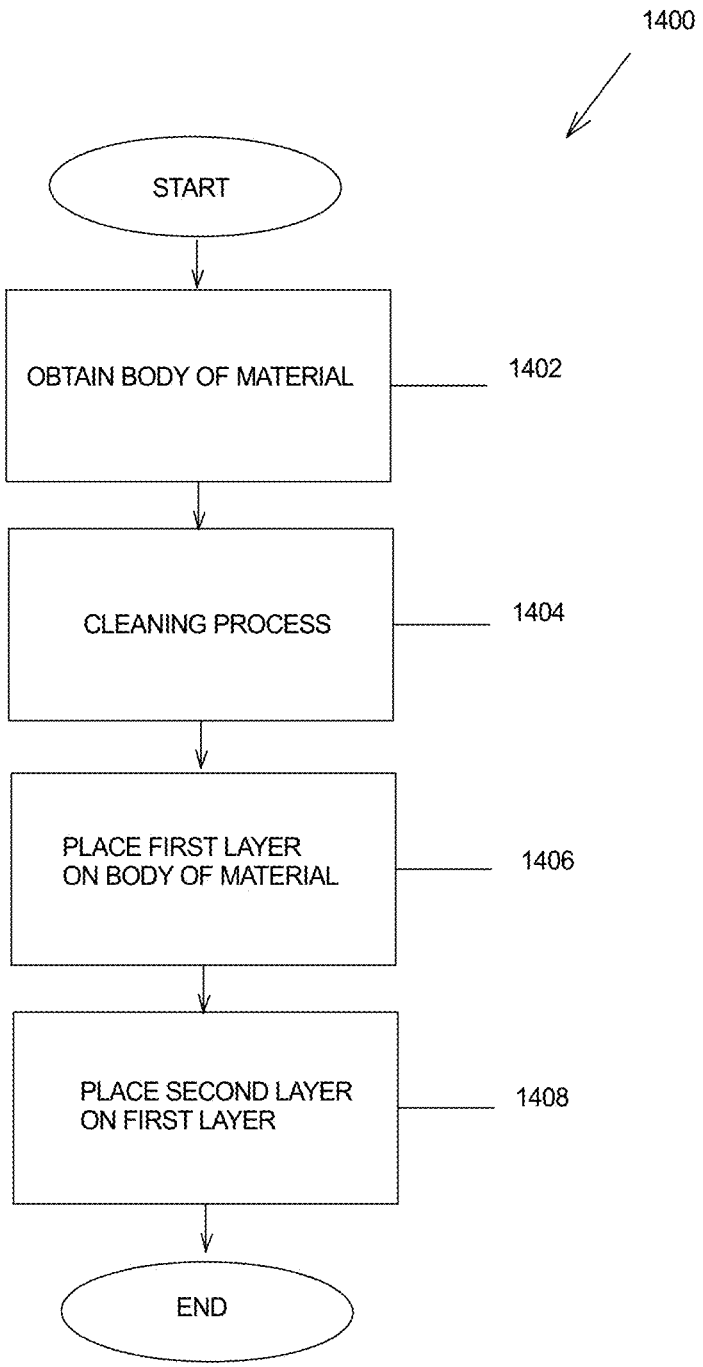
FIG. 9 is a method for producing Lead-free metallic barrier coatings for Copper and Zinc-rich surfaces of subterranean hardware and components in one example embodiment of the disclosure.

Referring to FIG. 9, a method 1400 in conformance with one example embodiment is disclosed. The method may make a Lead-free metallic barrier coating for Copper and Zinc-rich surfaces for subterranean hardware and components. At 1402, the method may comprise obtaining a body of material, wherein the body of material has one of a Copper and Zinc-rich surface. At 1404, the method may further comprise cleaning the body of material. As will be understood, the cleaning may be, for example, as provided above in relation to FIG. 1. At 1406, the method may further comprise covering at least a portion of a surface of the body of material with a first layer. At 1408, the method may further comprise covering at least a portion of the first layer with a second layer wherein the second layer has a composition of: (Bi+Sb)/(Sn+Zn) in between 0.5 and 3.0 wt. percent, Bi: 27 to 70 wt. percent, Sn: 5 to 40 wt. percent, Sb, Zn, and other elements as balance, and is characterized by a hardness of 18 HVN, or at least 4 times higher than the hardness of Lead in the HVN scale, wherein Bi represents Bismuth, Sb represents Antimony, Sn represents Tin, and Zn represents Zinc.

Example embodiments of the claims will now be disclosed. The example embodiments should not be considered limiting. In one example embodiment, a component is disclosed. The component may comprise at least two consecutive layers wherein a first layer is reactive to at least one of Copper and Zinc, produces an intermetallic when in contact with at least one of solid Copper and Zinc, and a second layer in contact with the first layer wherein the second layer has a compositional range of approximately: (Bi+Sb)/(Sn+Zn) in between 0.5 and 3.0, Bi: 27 to 70 wt. percent, Sn: 5 to 40 wt. percent, Sb, Zn, and other elements as balance and is characterized by a hardness of 18 HVN, or at least 4 times higher than the hardness of Lead in the HVN scale, wherein Bi represents Bismuth, Sb represents Antimony, Sn represents Tin, and Zn represents Zinc.

In another example embodiment, the component may comprise a thickness of the at least two consecutive layers has a total thickness of between 10 mm and 125 mm.

In another example embodiment, the component may further comprise a third layer liquefying between 120 degrees C. and 450 degrees C.

In another example embodiment, the component may be configured wherein the second layer has less than 35 wt. percent of intermetallic phases.

In another example embodiment, the component may be configured wherein the first layer is applied onto galvanized steel.

In another example embodiment, the component may be configured wherein the first layer is applied to a one of a Copper alloy and Zinc alloy.

In another example embodiment, the component may be configured wherein the component is configured to convey electrical energy.

In another example embodiment, the component may be configured wherein the first layer is applied to at least one of a steel wire armor and a pin.

In another example embodiment, the component may be configured wherein the component is a downhole centralizer.

In another example embodiment, the component may be configured wherein the component is a pump.

In another example embodiment, the component may be configured wherein the pump is one of a electric submersible pump or a progressive cavity pump.

In another example embodiment, the component may be configured wherein the component is a component of one of a downhole cable, a slickline, instrumentation line and actuator.

In another example embodiment, the component may be configured wherein the component is a portion of a intentionally degradable downhole component.

In another example embodiment, a method for production of a component is disclosed. The method may comprise obtaining a body of material, wherein the body of material has one of a Copper and Zinc-rich surface. The method may also comprise cleaning the body of material. The method may also comprise covering at least a portion of a surface of the body of material with a first layer. The method may also comprise covering at least a portion of the first layer with a second layer wherein the second layer has a composition of: (Bi+Sb)/(Sn+Zn) in between 0.5 and 3.0 wt. percent, Bi: 27 to 70 wt. percent, Sn: 5 to 40 wt. percent, Sb, Zn, and other elements as balance, and is characterized by a hardness of 18 HVN, or at least 4 times higher than the hardness of Lead in the HVN scale, wherein Bi represents Bismuth, Sb represents Antimony, Sn represents Tin, and Zn represents Zinc.

In another example embodiment, the method may be performed wherein the covering of the first layer with the second layer is through a hot dipping process.

In another example embodiment, the method may be performed wherein the hot dipping process is characterized by an alloy melting temperature of +25 degrees C., and no less than 120 degrees C.

In another example embodiment, the method may be performed wherein the hot dipping process creates a barrier.

In another example embodiment, the method may be performed wherein the covering of the first layer with the second layer is through an electroplating process.

In another example embodiment, the method may be performed wherein the electroplating process creates a barrier.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A component, comprising:

a base substrate comprising a metal alloy selected from the group consisting of galvanized steel, a copper alloy, and a zinc alloy;

at least two consecutive layers comprising a first layer and a second layer in contact with the first layer; and a third layer, wherein the first layer is reactive to at least one of copper or zinc, and wherein the first layer produces an intermetallic when in contact with at least one of solid copper or zinc, wherein the second layer consists of:

a weight ratio of (Bi+Sb)/(Sn+Zn) in between 0.5 and 3.0;

Bi: 27 to 70 wt. percent;

Sn: 5 to 40 wt. percent; and one or more of Sb, Zn, Cu, Ni, Cr, and Mo as balance, wherein the second layer is characterized by a hardness of at least 18 HVN, and wherein the third layer liquifies between 120° C. and 450° C.

2. The component according to claim 1, wherein a thickness of the at least two consecutive layers is between 10 mm and 125 mm.

3. The component according to claim 1, wherein the second layer has less than 35 wt. percent of intermetallic phases.

4. The component according to claim 1, wherein the substrate is galvanized steel.

5. The component according to claim 1, wherein the substrate is one of a copper alloy or zinc alloy.

6. The component according to claim 1, wherein the component is configured to convey electrical energy.

7. The component according to claim 1, wherein the first layer is applied to at least one of a steel wire armor or a pin.

8. The component according to claim 1, wherein the component is a downhole centralizer.

9. The component according to claim 1, wherein the component is a pump.

10. The component according to claim 9, wherein the pump is one of an electric submersible pump or a progressive cavity pump.

11. The component according to claim 1, wherein the component is a component of one of a downhole cable, a slickline, instrumentation, line, or actuator.

12. The component according to claim 1, wherein the component is a portion of an intentionally degradable downhole component.

13. A method for production of producing the component of claim 1, comprising:

obtaining a body of material, wherein the body of material has one of a copper-rich or a zinc-rich surface;

cleaning the body of material;

covering at least a portion of a surface of the body of material with the first layer; and covering at least a portion of the first layer with the second layer.

14. The method according to claim 13, wherein the covering of the first layer with the second layer is through a hot dipping process.

15. The method according to claim 14, wherein the hot dipping process is characterized by an alloy melting temperature of +25° C., and no less than 120° C.

16. The method according to claim 14, wherein the hot dipping process creates a barrier.

17. The method according to claim 13, wherein the covering of the first layer with the second layer is through an electroplating process.

18. The method according to claim 17, wherein the electroplating process creates a barrier.

19. A zone isolation plug, comprising:

a base substrate comprising a metal alloy selected from the group consisting of galvanized steel, a copper alloy, and a zinc alloy;

at least two consecutive layers comprising a first layer and a second layer in contact with the first layer; and a third layer, wherein the first layer is reactive to at least one of copper or zinc, wherein the first layer produces an intermetallic when in contact with at least one of solid copper or zinc, wherein the second layer consists of:

Bi, in a concentration of 27% to 70% by weight;

Sn, in a concentration of 5% to 40% by weight;

Sb, in a concentration of 0% to 34.3% by weight;

Zn, in a concentration of 0% to 35% by weight;

Cu, in a concentration of 5% to 40% by weight;

Ni, in a concentration of 0% to 2% by weight;

Cr, in a concentration of 0% to 2% by weight; and

Mo, in a concentration of 0% to 2% by weight, wherein a weight ratio of (Bi+Sb)/(Sn+Zn) in the second layer is between 0.5 and 3.0, wherein the second layer has less than 35% by weight of intermetallic phases, wherein the second layer is characterized by a hardness of at least 18 HVN, and wherein the third layer liquifies between 120° C. and 450° C.

* * * * *